US008777077B2

(12) United States Patent
McClain

(10) Patent No.: US 8,777,077 B2
(45) Date of Patent: Jul. 15, 2014

(54) PRY BAR HOLDER

(76) Inventor: Douglas McClain, Columbia, NJ (US)

( * ) Notice: Subject to any disclaimer, the term of this patent is extended or adjusted under 35 U.S.C. 154(b) by 230 days.

(21) Appl. No.: 13/328,758

(22) Filed: Dec. 16, 2011

(65) Prior Publication Data

US 2012/0152997 A1 Jun. 21, 2012

Related U.S. Application Data

(60) Provisional application No. 61/424,290, filed on Dec. 17, 2010.

(51) Int. Cl.
*A45F 5/00* (2006.01)

(52) U.S. Cl.
USPC ..... 224/676

(58) Field of Classification Search
USPC ..... 224/676
See application file for complete search history.

(56) References Cited

U.S. PATENT DOCUMENTS

| | | | | |
|---|---|---|---|---|
| 3,680,834 | A | 8/1972 | Holloway | |
| 3,774,730 | A | 11/1973 | Maddux | |
| 3,854,639 | A | 12/1974 | Genchi | |
| 4,106,679 | A | 8/1978 | Hillinger | |
| D251,542 | S | 4/1979 | Ozvath | |
| 4,457,462 | A | 7/1984 | Taormina | |
| 4,496,088 | A | 1/1985 | Tuthill | |
| D280,571 | S | 9/1985 | Viio | |
| D286,949 | S | 12/1986 | Hardman | |
| 4,819,847 | A | 4/1989 | Anderson | |
| 4,932,576 | A | 6/1990 | Ashley | |
| 4,936,499 | A | 6/1990 | Gulley | |
| 5,195,667 | A | 3/1993 | Gallant | |
| 5,511,705 | A | 4/1996 | Dreszer | |
| 5,568,889 | A | 10/1996 | Holloway | |
| 5,673,830 | A | 10/1997 | Matthews | |
| 5,695,172 | A | 12/1997 | Hreha | |
| 5,697,538 | A * | 12/1997 | Goldenberg et al. | 224/676 |
| 5,842,620 | A | 12/1998 | Koudakis | |

(Continued)

FOREIGN PATENT DOCUMENTS

| | | | |
|---|---|---|---|
| JP | 2003311660 | A2 | 5/2003 |
| JP | 2008 105104 | A | 5/2008 |
| WO | WO8803461 | A1 | 5/1988 |
| WO | WO2005055773 | A1 | 6/2005 |

OTHER PUBLICATIONS

PCT International Search Report and Written Opinion; PCT/US2011/065551; Aug. 29, 2012.

(Continued)

*Primary Examiner* — Brian D Nash
(74) *Attorney, Agent, or Firm* — Gearhart Law, LLC

(57) ABSTRACT

The current invention discloses a safe and inexpensive tool holder designed to accommodates a pry bar or other tools. The holder comprises: a plate member having a top surface and a bottom surface, wherein the plate member has an elongated holding slot connecting the top surface to the bottom surface and sized to be a loose fit to the pry bar, the elongated holding slot roughly divides the plate member to a proximal section and a distal section; a blocking beam attached to the bottom surface of the plate member, residing adjacent to the elongated holding slot and on the distal section of the plate member; and attachment structures that affix the plate member to the belt. The pry bar holder may further comprise a specially designed backrest that attaches the pry bar holder to a belt.

19 Claims, 13 Drawing Sheets

(56) References Cited

U.S. PATENT DOCUMENTS

| | | | | |
|---|---|---|---|---|
| 6,508,390 | B1 * | 1/2003 | Karpati | 224/270 |
| 6,651,855 | B1 | 11/2003 | Flynn | |
| 6,679,404 | B2 | 1/2004 | Brandt | |
| 6,698,632 | B1 * | 3/2004 | Turner et al. | 224/196 |
| 6,834,767 | B1 * | 12/2004 | Lin | 211/70.6 |
| 6,880,794 | B1 | 4/2005 | Kahn | |
| 7,077,303 | B2 | 7/2006 | Zega | |
| 7,314,153 | B2 * | 1/2008 | Musarella et al. | 224/269 |
| D586,641 | S | 2/2009 | Flynn | |
| D600,103 | S | 9/2009 | Fraga | |
| 7,784,658 | B1 * | 8/2010 | Hansen | 224/674 |
| 2001/0035445 | A1 * | 11/2001 | Kamiya | 224/271 |
| 2004/0108346 | A1 * | 6/2004 | Pablo | 224/251 |
| 2005/0133561 | A1 | 6/2005 | Kimball | |
| 2010/0133305 | A1 | 6/2010 | Stewart | |
| 2012/0325882 | A1 * | 12/2012 | Tages et al. | 224/676 |

OTHER PUBLICATIONS

PCT International Preliminary Report on Patentability; PCT/US2011/065551; Jun. 18, 2013.

* cited by examiner

PRY BAR HOLDER

CLAIM OF PRIORITY

This application claims priority to U.S. Provisional Patent Application No. 61/424,290 filed on Dec. 17, 2010, the contents of which are fully incorporated herein by reference.

FIELD OF THE INVENTION

The invention relates to devices for carrying tools, and more particularly to a pry bar holder, worn on a belt, to accommodate a pry bar or other tools.

BACKGROUND OF THE INVENTION

It is common practice for craftspeople to wear tool carrying devices, such as a pry bar, on their belts.

FIG. 1A shows an isometric view of a typical tool holder. This generic tool holder 100, intended for carrying a hammer 160, has a holding loop 110 that is attached to a tool backrest 120.

As shown in FIG. 1B, a craftsperson 130 may attach the generic tool holder 100 to their belt 140 by means of the generic tool holder 100 belt attachment 150. Once the generic tool holder 100 is attached to the craftsperson's belt 140, the holding loop 110 is substantially horizontal and provides a convenient place for a craftsperson to temporarily store a hand tool, in this instance, a 130 hammer 160. The generic tool holder 100 is a simple, but effective, device that frees up both of a craftsperson 130 hands while ensuring that hammer 160 readily available.

Another tool that is commonly used in the construction industry is a pry bar 200, shown in an isometric view in FIG. 2A. The pry bar 200 is a general purpose tool used for removing nails, opening crates, demolishing walls, lifting and in many other situations where one item has to be moved with respect to another.

A pry bar 200 is typically made of steel and has an elongated handle 210. At one end, the pry bar 200 typically has a claw 220 extending in a direction that may be generally perpendicular to the handle. The claw 220 may be joined to the elongated handle 210 by an outwardly curved fulcrum 230 that may have a lateral offset 240 from the elongated handle 210. At a second end, the pry bar 200 may have a second claw 290.

One of ordinary skill in the art will readily appreciate that, because of its shape, a device such as a pry bar 200 is not as easily stored on a belt via a generic tool holder 100 as other common tools such as hammers or screwdrivers. A horizontal sectional view of a pry bar is a very slim rectangular shape. The design of the generic tool holder 100 is too simple to ensure that a pry bar 200, while hanging from such generic tool holder 100, does not tilt and fall off, with the potential of causing serious injuries or damages. Moreover, the design of the generic tool holder 100 dictates that a pry bar is held very close to the body of the craftsperson 130 because the opening that holds a pry bar is right adjacent to the tool backrest 120, which is directly attached to the belt 140. Therefore, due to its shape, either claw 220 or second claw 290 will stay abut the body of the craftsperson 130 and may be pushed against the body and cause injuries.

As shown in FIG. 2B, prior art pry bar holders 250 have been produced. Like the device shown in FIG. 2*b*, these prior art pry bar holders 250 tend to be complex. They may, for instance, have a separate pry bar holding slot 260 to accommodate the elongated handle 210, a separate claw rest 270 to accommodate the claw 220 extending in a direction generally perpendicular to the handle and a handle rest 280 to help prevent the pry bar 200 from twisting. The complexity of the prior art pry bar holders 250 make them significantly more expensive than, for instance, the simple generic tool holder 100 shown in FIG. 1A. The simple generic tool holder 100, on the other hand, causes many safety concerns, as indicated above.

The present invention overcomes the problems of the prior arts by providing a simple and inexpensive pry bar holder that is safe and easy to use.

DESCRIPTION OF THE RELATED ART

The relevant prior art involving tool holders includes:

U.S. Pat. No. 6,651,855 issued to Flynn on Nov. 25, 2003 that describes a holder for a pry bar of the type having an elongated handle, a claw extending in a direction generally perpendicular to the handle, and an outwardly curved fulcrum interconnecting the handle and the claw. The holder includes a loop through which the handle can be inserted in a vertical direction, a seat positioned above the loop for engaging the claw to support the pry bar in a hanging position with the handle captured by the loop, and a bumper below the loop for lateral engagement by the handle to keep the claw on the seat.

U.S. Pat. No. 4,932,576 issued to Ashley on Jun. 12, 1990 for a "Pouch assembly for carpenters and other tradesmen". This describes a nail and screw pouch and tool holder assembly includes one or more slidable belt-attached pouch holders with slots through which a belt passes, worn by the user. Each pouch holder, which may be of leather so as to be relatively stiff, has a pouch hanger member formed of a generally horizontal rigid bar or rail with a plurality of depending U-shaped sections, each for supporting and locating a clip from which a pouch or tool holder hangs.

U.S. Pat. No. 5,195,667 issued to Gallant on Mar. 23, 1993 for a "Tool holder". This describes a device for suspending T-shaped tools from a belt, toolbox, wall, or other mount, comprising a flat attachment material and a rotating holder body which secures the tool while allowing the tool to be inserted and removed from different angles. In order to ensure that the holder body stays in a useful position, its swing is limited by two stops which act as brakes and are affixed so as to protrude perpendicularly from the attachment material. The invention is designed so that after the tool is inserted into the holder, the head of the tool remains secured by the cantilevering action of a spring-loaded clip against a dead-lock arm extending downwards from the holder body. The opposite end of the tool rests on an L-shaped extending at right angles from the attachment material. The tool is removed by the natural motion of grasping the handle and swinging upwards. This results in the tool being held in an immediately usable manner as it is withdrawn from the holder.

US Patent Publication no. 2010/013,305 submitted by Stewart on Jun. 3, 2010 for a "BELT MOUNTED TOOL HOLDER". This describes a belt mounted sleever bar holder includes a belt receiving member of flexible material formed into a belt receiving loop and designed to receive a belt there through so as to securely hold the belt receiving member on a belt. A metal mounting plate is fixedly attached to an outer surface of the belt receiving member and an L-shaped metal sleever bar receiving member with a substantially vertically oriented arm and a substantially horizontally oriented arm is pivotally attached parallel with an outer surface of the mounting plate for limited rotary movements of the vertical arm relative to the mounting plate. The horizontally oriented arm includes a sleever bar receiving opening there through.

Various implements are known in the art, but fail to address all of the problems solved by the invention described herein. One embodiment of this invention is illustrated in the accompanying drawings and will be described in more detail herein below.

SUMMARY OF THE INVENTION

The present invention provides a pry bar holder that may accommodate a pry bar with enhanced safety to a wearer. In addition, by attaching the pry bar holder to a specially designed backrest, the combination can be worn directly on a belt without additional attachment structures. Moreover, though the invention is termed as a "pry bar holder," it should be clear that the basic design of the current invention allows it to serve as holder to many kinds of tools, such as but are not limited to: hammer, screwdriver, wrench, handsaw, vise grips, wire cutter/stripper, pliers, steel chisel, utility knife, drill with bit, and other tools that need to be carried around.

Several preferred embodiments that share a core design are disclosed herein. In general, the pry bar holder for carrying a pry bar on a belt comprises: a plate member having a top surface and a bottom surface, wherein the plate member has an elongated holding slot connecting the top surface to the bottom surface and sized to be a loose fit to the pry bar, the elongated holding slot roughly divides the plate member to a proximal section and a distal section; a blocking beam attached to the bottom surface of the plate member, residing adjacent to the elongated holding slot and on the distal section of the plate member; and attachment structures that affix the plate member to the belt. The pry bar holder of the present invention may further include a backrest having a front side, a back side and belt attachment mechanisms, and attachment structures affixed to the plate member to attach the plate member to the front side of the backrest, wherein the plate member is generally perpendicular to the front side of the backrest.

The pry bar holder disclosed here does not require additional attachment device to be affixed to a craftsperson's belt. While a backrest is preferably used, the pry bar holder may be worn directly on a belt and the pry bar or any other tool that needs to be carried around may hang vertically though the holding slot on the plate member. The plate member is generally designed to be strong enough to withstand all kinds of tools and it is not easily broken or distorted, reducing the likelihood that the pry bar will fall. The holding slot is generally an elongated hole that fits the sectional shape of a pry bar. Nevertheless, the size and shape of the plate member and the holding slot may vary according to the type, size, and shape of the tool that is to be carried.

The pry bar holder has a blocking beam that is attached to the bottom surface of the plate member. While the holding slot is generally an elongated hole, it roughly separates the plate member to a proximal section, which is closer to the back rest, and a distal section. The blocking beam may be attached to the bottom surface of the plate member, on the side the distal section. In practice, the blocking beam prevents a pry bar hanging through the holding slot from tilting outward and falling off the holder. Thus, the blocking beam enhances the safety of the pry bar holder.

Therefore, the present invention succeeds in conferring the following, and others not mentioned, desirable and useful benefits and objectives.

It is an object of the present invention to provide a pry bar holder that is inexpensive.

It is an object of the present invention is to provide a pry bar holder with a strong and robust plate member having a holding slot for a pry bar.

Still another object of the present invention is to provide a pry bar holder that makes it safer to attach a pry bar to a craftsman's belt, with reduced likelihood that the pry bar will fall off the holder.

Yet another object of the present invention to provide a pry bar holder that may be directly attached to a belt without additional devices.

Still another object of the present invention is to provide a device that will safely, but temporarily, secure a pry bar by adapting a belt worn hammer holder.

Still another object of the present invention is to provide a convenient and easy to use, easy-to-attach pry bar holder that may be affixed to a user's belt.

BRIEF DESCRIPTION OF THE DRAWINGS

FIG. 3 A-I show a first preferred embodiment of the pry bar holder:

FIG. 4A is a top perspective view of the second preferred embodiment;

FIG. 4B is a top perspective view of the plate member in the second preferred embodiment when the plate member is opened to show the top half and bottom half of the plate member;

FIG. 4C is a top view of the second preferred embodiment;

FIG. 4D is a bottom view of the second preferred embodiment;

FIG. 4E is a front view of the second preferred embodiment;

FIG. 4F is a back view of the second preferred embodiment;

FIG. 4G is a first side view of the second preferred embodiment; and

FIG. 4H is a second side view of the second preferred embodiment.

FIG. 4I is a sectional first side view of the second preferred embodiment.

FIG. 5 A-G show a third preferred embodiment of the pry bar holder:

FIG. 6A is a top perspective view of the fourth preferred embodiment while it is attached to a backrest;

FIG. 6B is a front view of the fourth preferred embodiment while it is attached to a backrest;

FIG. 6C is a back view of the fourth preferred embodiment while it is attached to a backrest;

FIG. 6D is a top view of the fourth preferred embodiment while it is attached to a backrest;

FIG. 6E is a bottom view of the fourth preferred embodiment while it is attached to a backrest;

FIG. 6F is a first side view of the fourth preferred embodiment while it is attached to a backrest; and FIG. 6G is a second side view of the fourth preferred embodiment while it is attached to a backrest.

FIG. 7A is a top perspective view of the fifth embodiment of the holder holding a pry bar when the holder is attached to a belt.

FIG. 7B is a back perspective view of a plate member of the fifth preferred embodiment of this invention.

FIG. 7C is a front perspective view of a plate member of the fifth preferred embodiment of this invention.

FIG. 7D is a top view of a plate member of the fifth preferred embodiment of this invention.

FIG. 7E is a side view of a plate member of the fifth preferred embodiment of this invention.

DESCRIPTION OF THE PREFERRED EMBODIMENTS

Figure 1A:
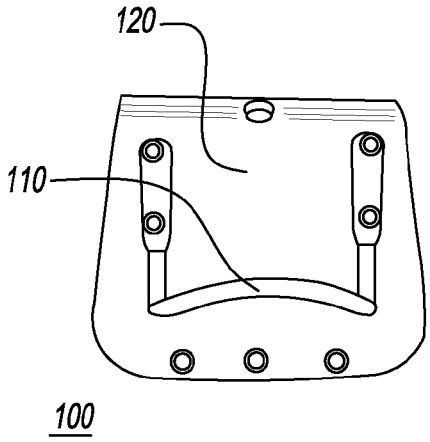
FIG. 1A shows an isometric view of a prior art tool holder.

The preferred embodiments of the present invention will now be described with reference to the drawings. Identical elements in the various figures are identified with the same reference numerals.

Reference will now be made in detail to embodiments of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto.

Figure 3B:
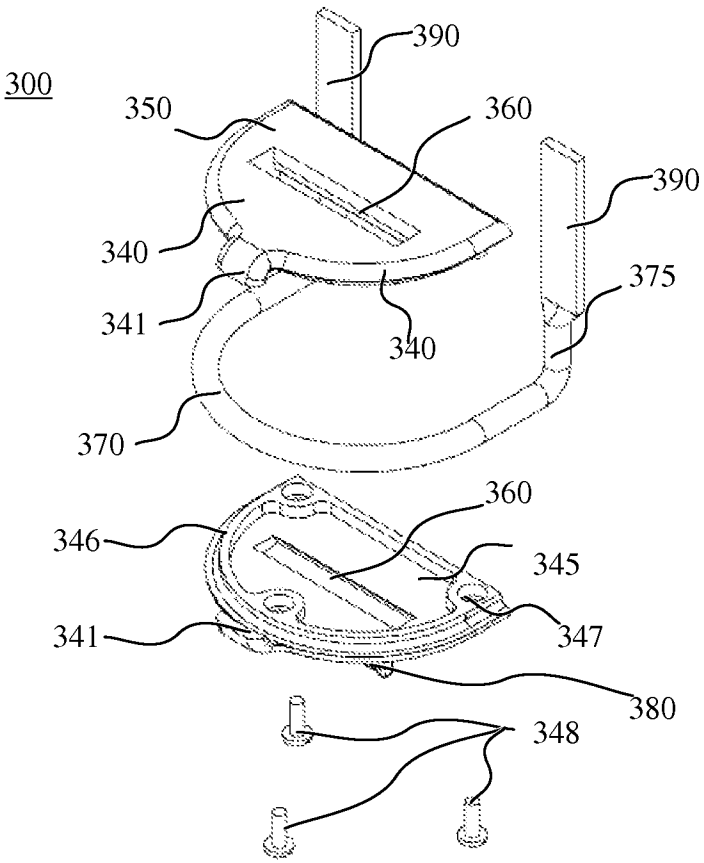
FIG. 3B is an exploded perspective view of the first preferred embodiment.
Figure 3A:
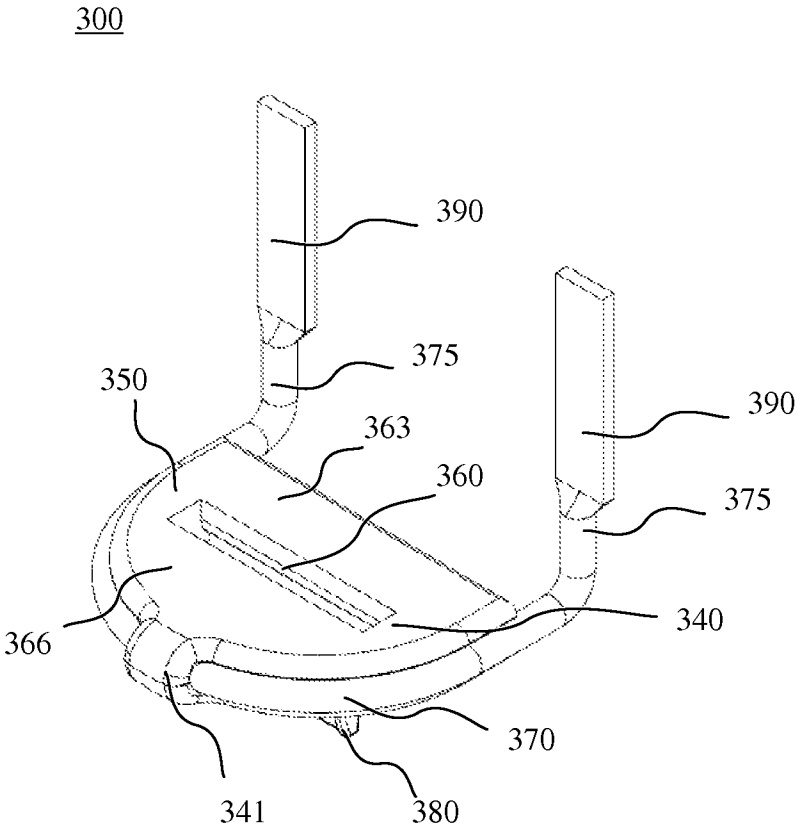
FIG. 3A is a top front perspective view of the first preferred embodiment.

FIG. 3A-I show a first preferred embodiment of the pry bar holder 300. FIG. 3A is a top front perspective view. Shown in FIG. 3A are a plate member 340, the plate member 340 having a top surface 350 and a plate holding loop wrap 341, an elongated holding slot 360 residing in the plate member 340, plate holding loop wraps 341, a blocking beam 380, and the attachment structures including attachment beams 390, vertical beams 375, and a plate holding loop 370. The elongated holding slot 360 roughly divides the plate member 340 to a proximal section 363, which is closer to the attachment beams 390, and a distal section 366, which is farther from the attachment beams 390.

FIG. 3B is an exploded top front perspective view of the first preferred embodiment of the pry bar holder 300 to demonstrate the inner structure of the plate member 340. Besides the elements shown in FIG. 3A, FIG. 3B shows the top half 343 of plate member 340 and the bottom half 345 of plate member 340 separately. The top half 343 and the bottom half 345 have plate holding loop wraps 341 and fitting grooves 346 that may accommodate the plate holding loop 370. Only the fitting groove 346 on the bottom half 345 of plate member 340 is shown here. The top half 343 and bottom half 345 of plate member 340 also have plate holding loop wraps 341. In addition, the bottom half 345 also has fastener holes 347 that may be used to attach the bottom half 345 and top half 343 of plate member 340 together with fasteners 348.

The plate member 340 is a major component of the pry bar holder 300. The plate member 340 needs to be strong and robust to withstand the weight of a pry bar. In addition, the plate member 340, especially the part closer to the elongated holding slot 360, should be strong enough to withstand friction with the pry bar. The plate member 340 may be one or more kinds of materials. The plate member 340 may be injection molded, or may be manufactured using any suitable method. The plate member 340 may be made of any material, including but not limited to, metal such as aluminum, titanium, iron or steel, rigid plastics, thermoplastics, elastomers, hard wearing rubbers, wood or wood products, metals, composites, or any combination of these materials or suitable materials which may become available in the future. Preferably, the plate member 340 of the present invention is made of metal or rigid plastic.

In this embodiment, the attachment structures include the attachment beams 390, the vertical beams 375, and the plate holding loop 370. The attachment structures fasten the plate member 340 to a craftperson's belt. A backrest may be used so that the attachment beams 390 are affixed to the backrest, which is then attached to a belt. Or the attachment beams 390 may be attached directly to a belt. As long as a secure attachment is ensured, any means to achieve the attachment is acceptable. For example, the attachment beams 390 may be attached to a backrest or a belt with screws, rivets, nails, staples, glue, or direct molding.

The attachment structures may be molded as a single piece or separated as connected parts. The attachment beams 390, vertical beams 375, and plate holding loop 370 may be made from same or different materials, including but not limited to: metal such as aluminum, titanium, iron or steel, rigid plastics, thermoplastics, elastomers, hard wearing rubbers, wood or wood products, metals, composites, or any combination of these materials or suitable materials which may become available in the future. Preferably, the attachment structures are made of metal, such as steel.

The elongated holding slot 360 connects the top surface 350 to the bottom surface 355 and is sized to be a loose fit to the pry bar. The elongated holding slot 360 goes through the plate member 340 and it is where a pry bar 200 may be asserted. Generally, when the pry bar holder is attached to the belt of a wearer, with or without a backrest, the attachment beams 390 are close to the wearer and the plate member 340 is situated parallel to the ground. The pry bar 200 may be asserted through the elongated holding slot 360 with the elongated handle 210 pointing to the ground, while the claw 220 remains above the plate member 340. Unlike prior art holder 250, which requires the claw 220 pointing towards the wearer because claw 220 is to be positioned on claw rest 270, the pry bar holder 300 by the current invention allows claw 220 to point either to or away from the body of the wearer. In general, when the claw 220 is pointing towards the body, it is preferred to have a pry bar holder backrest that provides a barrier between claw 220 and the wearer.

In this particular embodiment, the plate member 340 may be divided into two parts: the top half 343 and the bottom half 345 of plate member 340, as shown in FIG. 3B. This design affords more flexibility in regard to the size of the pry bar that may be carried because the plate member 340 may be removed and different plate members 340 having different sizes of the elongated holding slots 360 may be attached in accordance with the actual pry bar that is to be carried. The top half 343 and the bottom half 345 of plate member 340 are connected with fasteners 348 such as screws. A user of the pry bar holder 300 may just unscrew the fasteners, remove the plate member 340, and change to another plate member 340 having an elongated holding slot 360 with a different size.

Figure 3C:
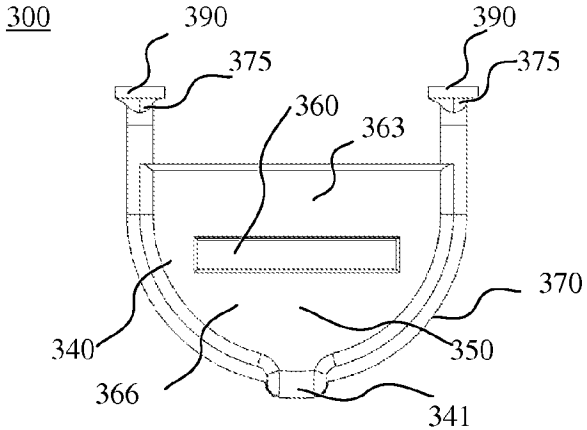
FIG. 3C is a top view of the first preferred embodiment.

FIG. 3C is a top view of the first preferred embodiment of the pry bar holder 300. Shown are the are plate member 340 having a top surface 350, the plate holding loop wrap 341, the elongated holding slot 360 residing in the plate member 340, the attachment beams 390, the vertical beams 375, and the plate holding loop 370. The elongated holding slot 360 roughly divides the plate member 340 to a proximal section 363, which is closer to the attachment beams 390, and a distal section 366, which is farther from the attachment beams 390.

Figure 3D:
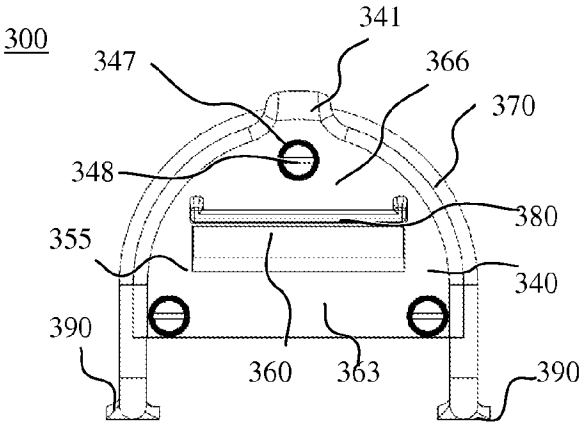
FIG. 3D is a bottom view of the first preferred embodiment.

FIG. 3D is a bottom view of the first preferred embodiment of the pry bar holder 300. Shown are the are plate member 340 having a bottom surface 355, the plate holding loop wrap 341, the elongated holding slot 360 residing in the plate member 340, the attachment beams 390, the blocking beam 380 that is attached to the bottom surface 355 of plate member 340 and resides adjacent to the elongated holding slot 360 on the distal section 366 of plate member 340, and the plate holding loop 370. Also shown in FIG. 3D are the fastener holes 347 and fasteners 348. From FIGS. 3C and 3D, it is clear that the holding slot 360 connects the top surface to the bottom surface of the plate member 340.

Figure 3E:
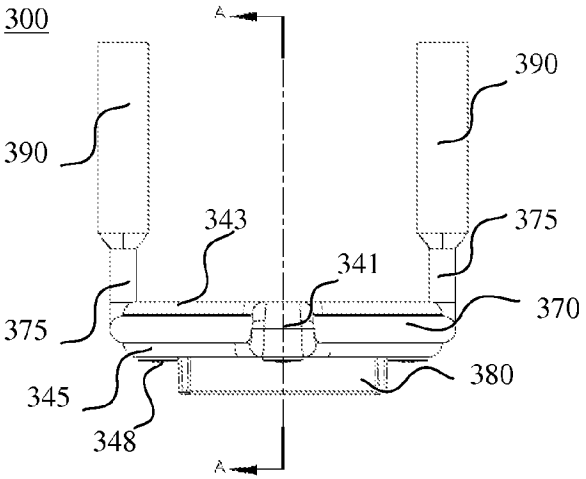
FIG. 3E is a front view of the first preferred embodiment.

FIG. 3E is a front view of the first preferred embodiment of the pry bar holder 300. Shown are the plate member 340 having a top half 343 and a bottom half, plate holding loop wraps 341, the attachment beams 390, the vertical beams 375, the blocking beam 380, the fasteners 348, and the plate holding loop 370. The pry bar holder 300 is symmetric through the A-A line shown in FIG. 3E.

Figure 3F:
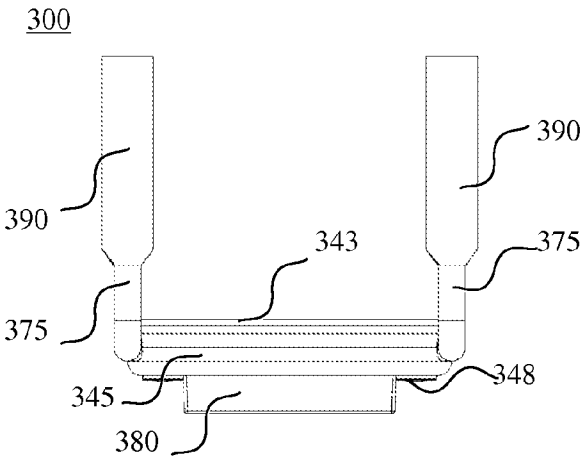
FIG. 3F is a back view of the first preferred embodiment.

FIG. 3F is a back view of the first preferred embodiment of the pry bar holder 300. Shown are the plate member 340 having a top half 343 and a bottom half 345, plate holding loop wraps 341, the attachment beams 390, the vertical beams 375, the blocking beam 380, the fasteners 348, and the plate holding loop 370. The pry bar holder 300 is symmetric through the A-A line shown in FIG. 3E.

The dimension of the pry bar holder 300 may vary according to the pry bar that is to be carried. In general, the width of the pry bar holder 300, measured as the distance between the attachment beams 390, may be 5 to 20 cm, and preferably around 8 cm. The height of the pry bar holder 300, measured from the top of the attachment beams 390 perpendicularly to the virtual plain where the unattached side of the blocking beam 380 resides, may be 5 to 20 cm, and preferably around 8 cm.

Figure 3I:
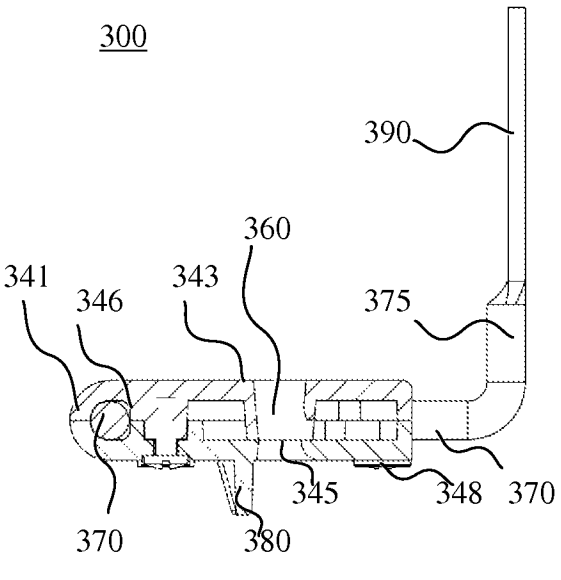
FIG. 3I is a sectional first side view of the first preferred embodiment.
Figure 3H:
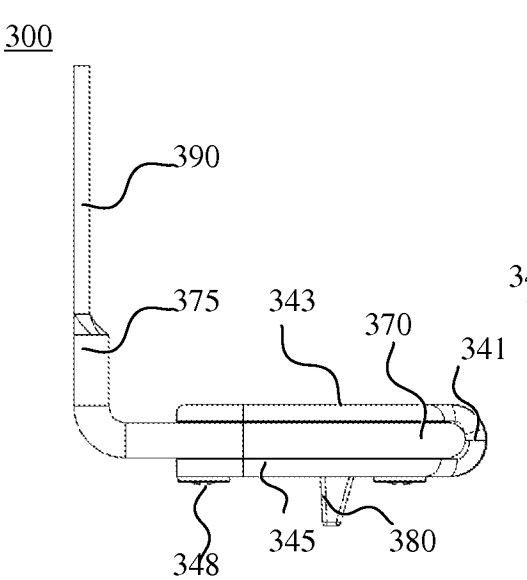
FIG. 3H is a second side view of the first preferred embodiment.
Figure 3G:
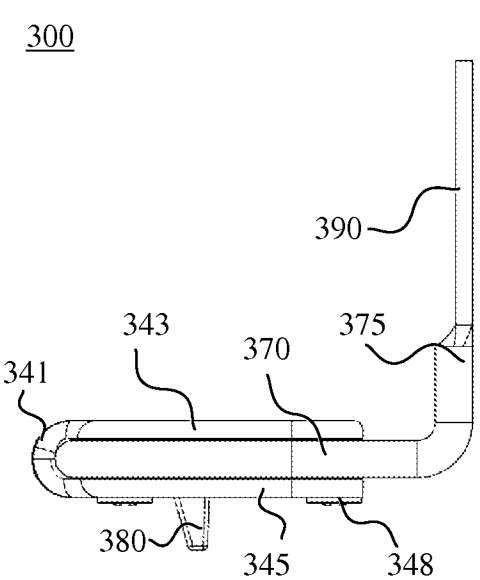
FIG. 3G is a first side view of the first preferred embodiment.

FIG. 3G is a first side view of the first preferred embodiment of the pry bar holder 300. Shown are the plate member 340 having a top half 343 and a bottom half 345, the attachment beams 390, the vertical beams 375, the blocking beam 380, the fasteners 348, and the plate holding loop 370.

FIG. 3H is a second side view of the first preferred embodiment of the pry bar holder 300. Shown are the plate member 340 having a top half 343 and a bottom half 345, the plate holding loop wraps 341, the attachment beams 390, the vertical beams 375, the blocking beam 380, the fasteners 348, and the plate holding loop 370.

FIG. 3I is a sectional first side view, across the A-A line as shown in FIG. 3E, of the first preferred embodiment of the pry bar holder 300. Shown are the plate member 340 having a top half 343 and a bottom half 345, the plate holding loop wraps 341, the elongated holding slot 360, the attachment beams 390, the vertical beams 375, the blocking beam 380, the filling groove 346, the fastener holes 347, the fasteners 348, and the plate holding loop 370.

Here it is clear that the filling grooves 346 of the top half 343 and bottom half 345 of plate member 340 fit together to accommodate the plate holding loop 370. Together with the filling grooves 346, the plate holding loop wraps 341 close around the plate holding loop 370 and ensure that the plate member 340 is firmly held to the plate holding loop 370, preventing the plate member 340 from movement while carrying a pry bar.

The blocking beam 380 is designed to prevent unintentional falling of the pry bar 200 from the pry bar holder 300. The blocking beam 380 is attached to the bottom surface 355 of plate member 340. In addition, the blocking beam 380 is anchored on the proximal section 363 of plate member 340, adjacent to the elongated holding slot 360. When a pry bar 200 is being carried on a pry bar holder 300, the lower end of the pry bar 200, the elongated handle 210, may be tilted or swung. Due to the shape of the pry bar 200, the pry bar 200 may fall through the slot if excessive swing or tilting is allowed. The blocking beam 380 reduces the angle that the pry bar may be tilted or swung, especially when the elongated handle 210 swings or tilts away from the wearer's body. In such a manner, the blocking beam 380 decreases the possibility that the pry bar 200 may fall from the pry bar holder 300.

FIG. 4 A-I show a second preferred embodiment of the pry bar holder 300. FIG. 4A is a top front perspective view. Shown in FIG. 4A are a plate member 340 having a top surface 350, an elongated holding slot 360 residing in the plate member 340, a blocking beam 380, and the attachment structures including attachment beams 390, vertical beams 375, and a plate holding loop 370. The top half 343 of the plate member 340 comprises: an overlaying layer 351 and a top half base 352, wherein the overlaying layer 351 has an extension to form a plate holding loop wrap 341 that wrap around the plate holding loop 370. The elongated holding slot 360 roughly divides the plate member 340 to a proximal section 363, which is closer to the attachment beams 390, and a distal section, which is farther from the attachment beams 390.

Figure 4B:
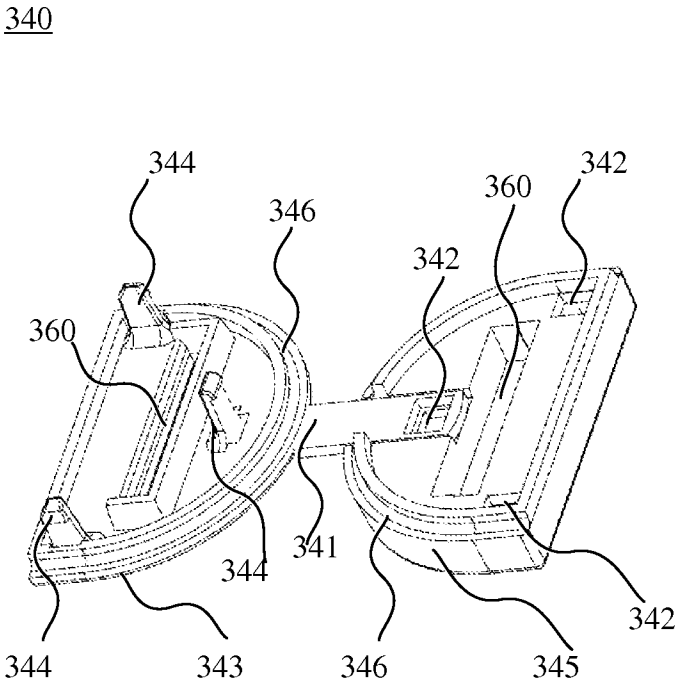
FIG. 4A-I show a second preferred embodiment of the pry bar holder.
Figure 4A:
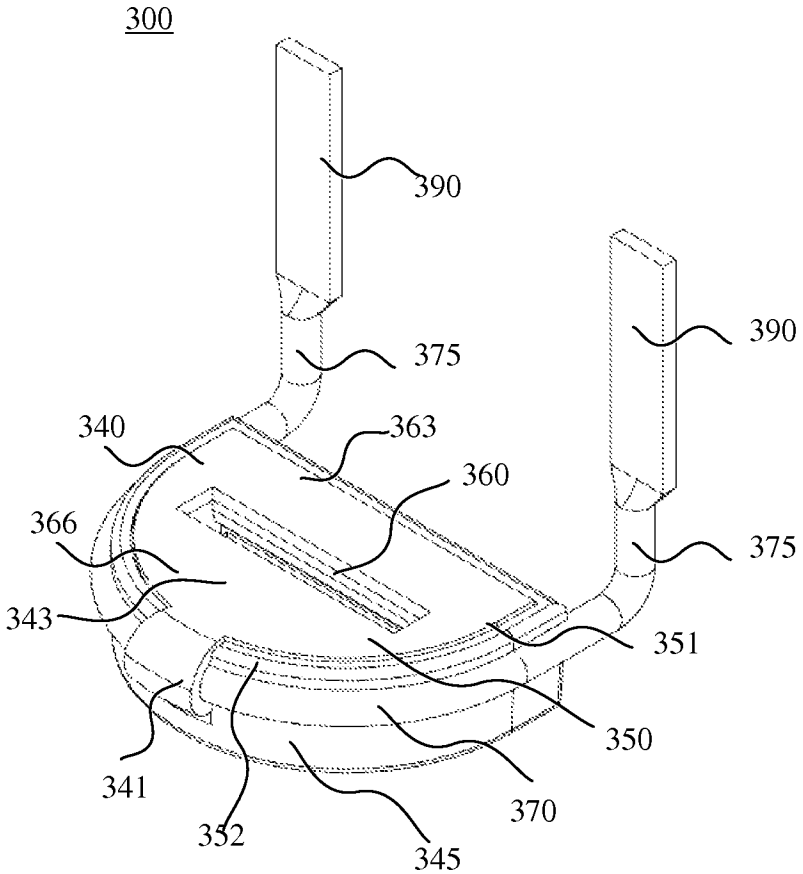

FIG. 4B is top perspective view of the plate member 340 when the plate member 340 is opened and the top half 343 and bottom half 345 of plate member 340 are mostly separated except for a connection by the plate holding loop wrap 341. Shown here are the blocking beam 380 and the plate member 340 having a top half 343, a bottom half 345, plate holding loop 370, and an elongated holding slot 360. The top half 343 of plate member 340 comprises an overlaying layer 351 and a top half base 352, wherein the overlaying layer 351 has an extension to form a plate holding loop wrap 341. There are also protruding snaps 344 that resides on the top half 343 of plate member 340. The bottom half 345 of plate member 340 has suspension holes 342 to capture the protruding snaps 344.

In the second preferred embodiment, the top half 343 and bottom half 345 of plate member 340 are not completely separated. Instead, the top half 343 and the bottom half 345 of plate member 340 are connected with the plate holding loop wrap 341, which is made from flexible but strong material, such as but not limited to rubber and flexible plastic materials.

Once closed, the top half 343 and the bottom half 345 of plate member 340 will be joined tightly together when the snapping holes 342 capture the protruding snaps. It should be noted that the design shown here is only supposed to be representative. For example, instead of snap mechanisms, other structures, such as a hook-and-loop design or screw fasteners, may be used. The protruding snaps 344 do not have to reside on the top half 343. The positions of the protruding snaps and the snapping holes may well be exchanged without affecting the combination of the top half 343 and the bottom half 345 of plate member 340. The top half 343 and the bottom half 345 have fitting grooves 346 that may accommodate the plate holding loop 370. In addition, the bottom half 345 also has snapping holes 342 that may be used to attach the bottom half 345 and top half 343 of plate member 340 together with snaps 344.

Figure 4D:
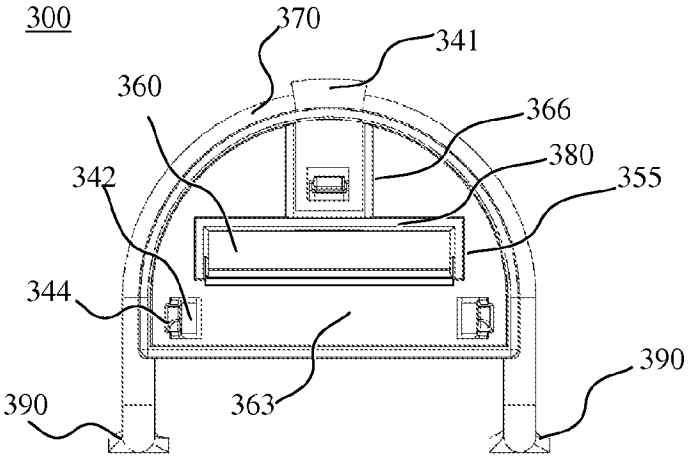
Figure 4C:
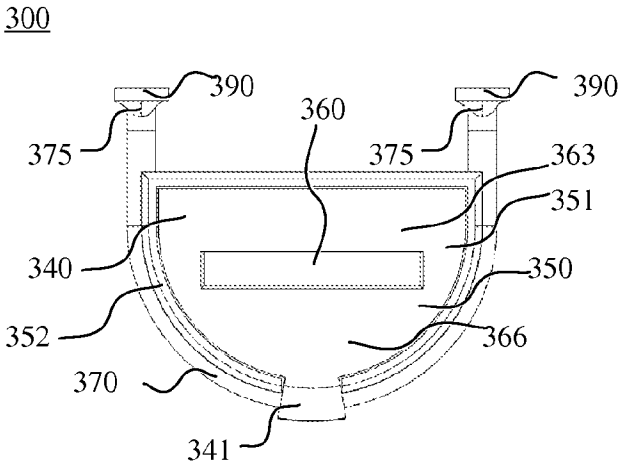

FIG. 4C is a top view of the second preferred embodiment of the pry bar holder 300. Shown are the are plate member 340 having a top surface 350, the elongated holding slot 360 residing in the plate member 340, the plate holding loop wraps 341, the attachment beams 390, the vertical beams 375, and the plate holding loop 370. The elongated holding slot 360 roughly divides the plate member 340 to a proximal section 363, which is closer to the attachment beams 390, and a distal section 366, which is farther from the attachment beams 390.

FIG. 4D is a bottom view of the second preferred embodiment of the pry bar holder 300. Shown are the are plate member 340 having a bottom surface 355, the elongated holding slot 360 residing in the plate member 340, the plate holding loop wraps 341, the attachment beams 390, the blocking beam 380 that is attached to the bottom surface 355 of plate member 340 and resides adjacent to the elongated holding slot 360 on the distal section 366 of plate member 340, and the plate holding loop 370. Also shown in FIG. 4D are the snapping holes 342 and snaps 344.

Figure 4F:
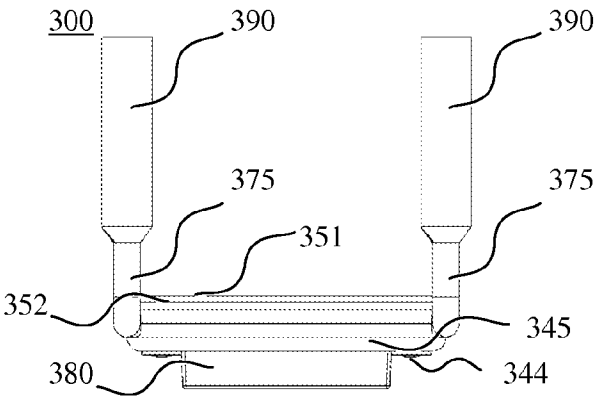
Figure 4E:
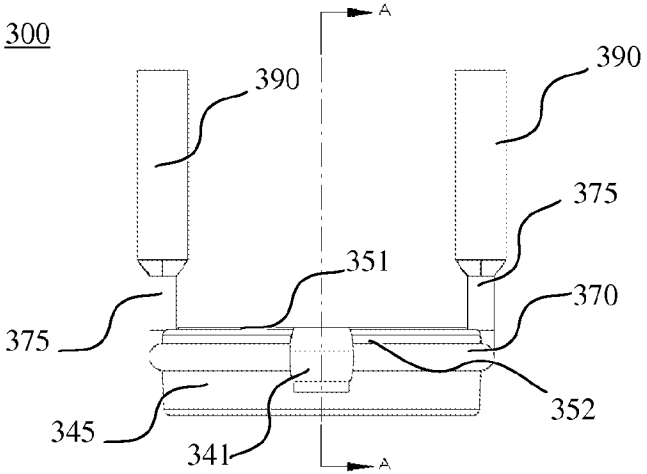

FIG. 4E is a front view of the second preferred embodiment of the pry bar holder 300. Shown are the plate member 340 having a top half 343 and a bottom half, the attachment beams 390, the vertical beams 375, and the plate holding loop 370. The pry bar holder 300 is symmetric through the A-A line shown in FIG. 4D.

FIG. 4F is a back view of the second preferred embodiment of the pry bar holder 300. Shown are the plate member 340 having a top half 343 and a bottom half 345, the attachment beams 390, the vertical beams 375, the blocking beam 380, the snaps 344, and the plate holding loop 370.

Figure 4I:
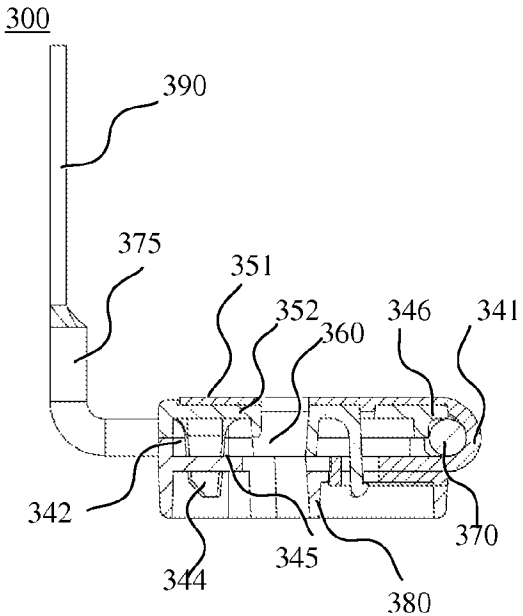
Figure 4H:
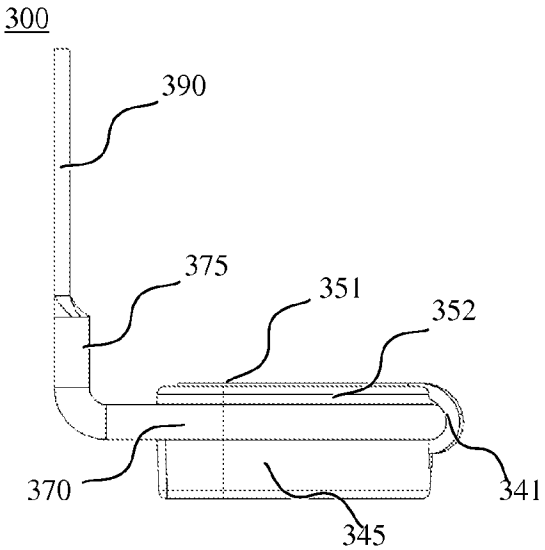
Figure 4G:
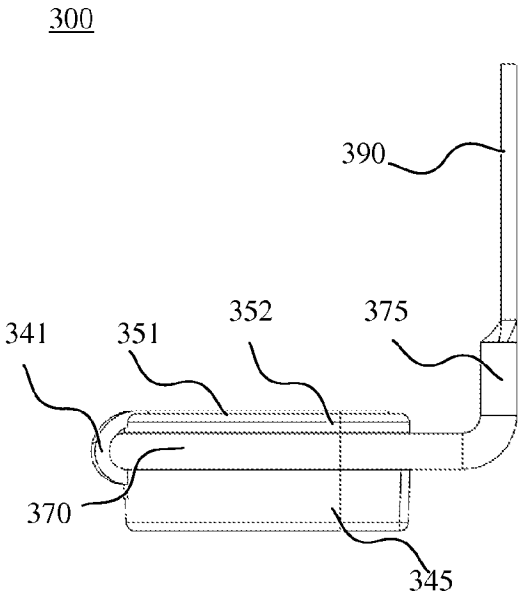

FIG. 4G is a first side view of the second preferred embodiment of the pry bar holder 300. Shown are the plate member 340 having a top half 343 and a bottom half 345, the attachment beams 390, the vertical beams 375, the blocking beam 380, the snaps 344, and the plate holding loop 370.

FIG. 4H is a second side view of the second preferred embodiment of the pry bar holder 300. Shown are the plate member 340 having a top half 343 and a bottom half 345, the attachment beams 390, the vertical beams 375, the blocking beam 380, the snaps 344, and the plate holding loop 370.

FIG. 4I is a sectional first side view, across the A-A line as shown in FIG. 4E, of the second preferred embodiment of the pry bar holder 300. Shown are the plate member 340 having a top half 343 and a bottom half 345, the attachment beams 390, the vertical beams 375, the blocking beam 380, the filling groove 346, the snapping holes 342, the snaps 344, and the plate holding loop 370.

FIG. 5 A-G show a third preferred embodiment of the pry bar holder 300. FIG. 5A is a top front perspective view. Shown in FIG. 5A are a plate member 340, the plate member 340 having a top surface 350, an elongated holding slot 360 residing in the plate member 340, a blocking beam 380, and a plate holding loop 370. The elongated holding slot 360 roughly divides the plate member 340 to a proximal section 363, which is closer to the attachment beams 390, and a distal section, which is farther from the attachment beams 390.

Figure 5B:
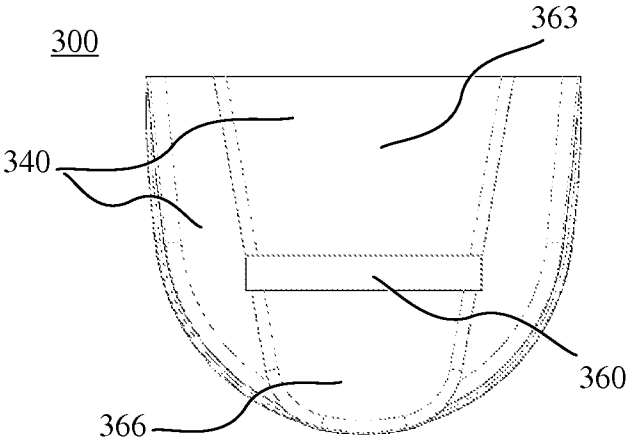
FIG. 5B is a top view of the third preferred embodiment.

FIG. 5B is a top view of the third preferred embodiment of the pry bar holder 300. Shown are the are plate member 340 having a top surface 350, a proximal section 363, and a distal section 366, and the elongated holding slot 360 residing in the plate member 340.

Figure 5C:
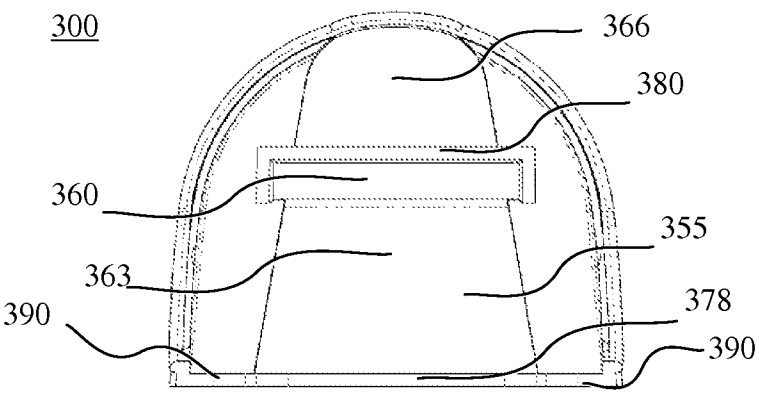
FIG. 5C is a bottom view of the third preferred embodiment.
Figure 5A:
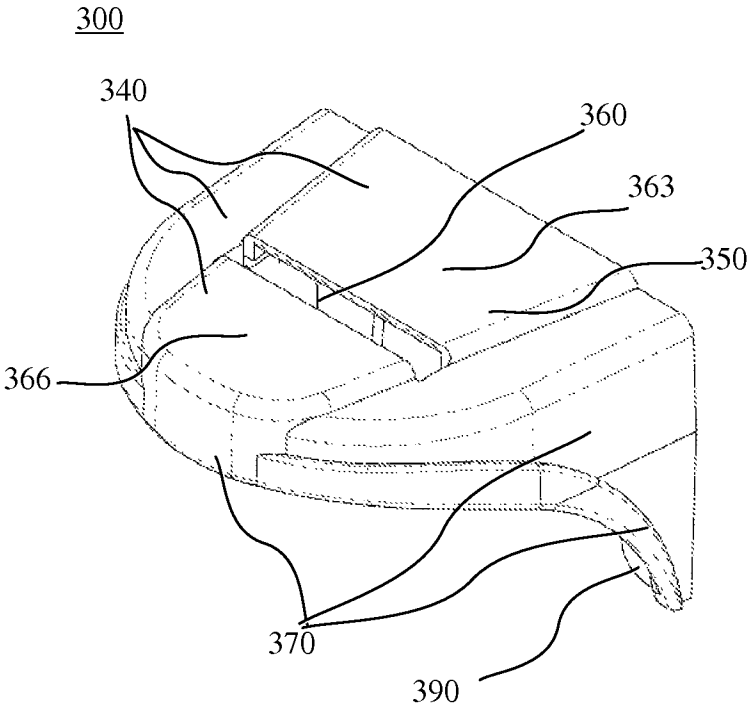
FIG. 5A is a top perspective view of the third preferred embodiment.

FIG. 5C is a bottom view of the third preferred embodiment of the pry bar holder 300. Shown are the are plate member 340 having a bottom surface 355, the elongated holding slot 360 residing in the plate member 340, the blocking beam 380 that is attached to the bottom surface 355 of plate member 340 and resides adjacent to the elongated holding slot 360 on the distal section 366 of plate member 340, the attachment beams 390, a horizontal beam 378, and the plate holding loop 370. From FIGS. 5C and 5D, it is clear that the elongated holding slot 360 connects the top surface 350 to the bottom surface 355 of plate member 340.

Figure 5E:
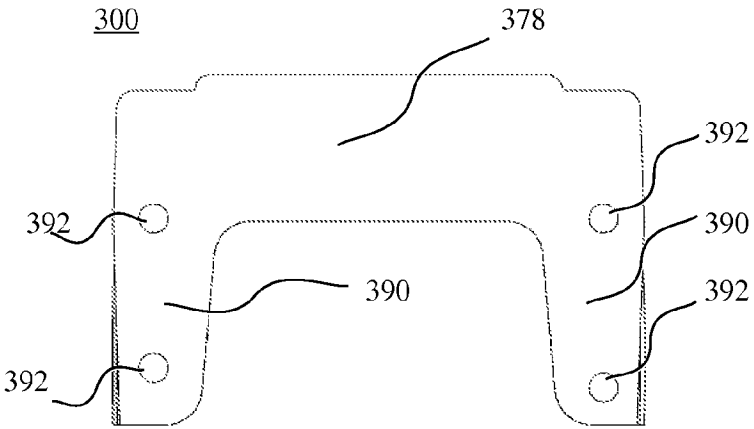
FIG. 5E is a back view of the third preferred embodiment.
Figure 5D:
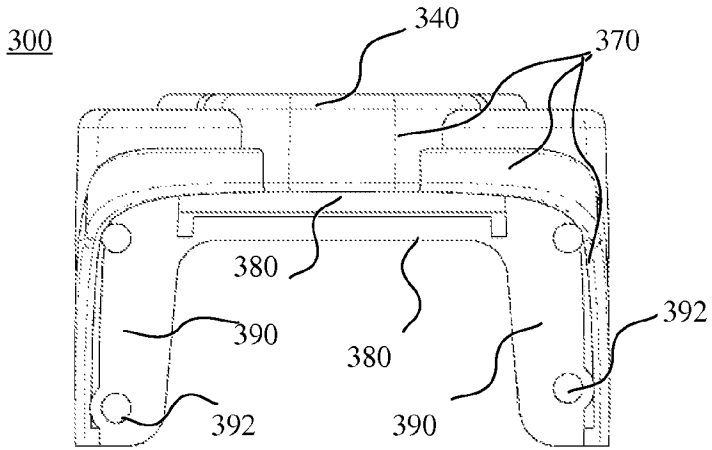
FIG. 5D is a front view of the third preferred embodiment.

FIG. 5D is a front view of the third preferred embodiment of the pry bar holder 300. Shown are the plate member 340 having a top half 343 and a bottom half, the attachment beams 390 having fastener holes 392, the horizontal beams 378, the blocking beam 380, and the plate holding loop 370. The horizontal beam 378 is positioned below the bottom surface 355 of plate member 340 and it connects to the attachment beams 390 and the plate member 340 to provide additional support.

The third preferred embodiment of the pry bar holder 300, while shares the core design with the first and second preferred embodiments, has certain differences that do not affect the major function of the holder, while allowing the manufacturing process to be more effortless. Here the attachment structures, which include the attachment beams 390, the plate holding loop 370, and a horizontal beam 378, are integrated with the plate member 340. In essence, here the plate member 340 and the attachment structures are molded or co-molded and form a single piece. Such a design improves the robustness of the pry bar holding. Since the different parts are integrated together, it is preferred that the parts are made of the same materials, as stated for the first preferred embodiment. However, if it is technically possible and desired, the various structures may also be made from different materials. The horizontal beam 378 serves similar functions as vertical beams 375 in FIGS. 3 and 4 may be considered as intermediary beams that provide additional support to attach the plate member 340 to a backrest or a belt.

FIG. 5E is a back view of the third preferred embodiment of the pry bar holder 300. Shown are the plate member 340, the attachment beams 390 having fastener hole 392, the horizontal beam 378.

The fastener holes 392 may be used to attach the pry bar holder 300 to a belt or to a backrest, which may be attached to a belt. Similar structures may be used on attachment beams 390 in other embodiments. Either a screw or a rivet may be used as fasteners for the attachment. However, it should be noted that fastener holes 392 shown here are only meant to be examples as to how the pry bar holder 300 may be attached. Other approaches, such as using a staple gun or permanent glue, may be adopted when it is convenient or economical to do so.

Figure 5G:
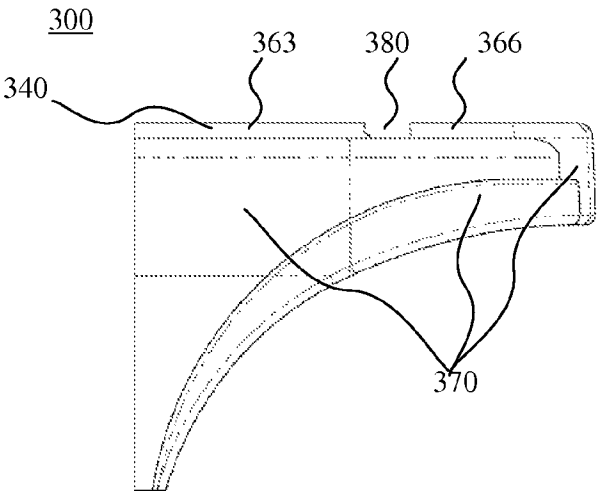
FIG. 5G is a second side view of the third preferred embodiment.
Figure 5F:
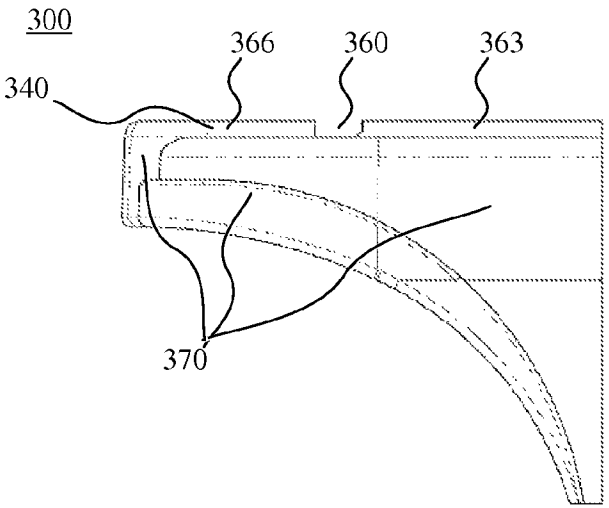
FIG. 5F is a first side view of the third preferred embodiment.

FIG. 5F is a first side view of the third preferred embodiment of the pry bar holder 300. Shown are the plate member 340, the elongated holding slot 360, and the plate holding loop 370.

FIG. 5G is a second side view of the third preferred embodiment of the pry bar holder 300. Shown are the plate member 340, the elongated holding slot 360, and the plate holding loop 370.

FIG. 6 A-G show a fourth preferred embodiment of a pry bar holder 300 when the pry bar holder is attached to a backrest 310. FIG. 6A is a top front perspective view. Shown in FIG. 6A are a plate member 340, the plate member 340 having a top surface 350, an elongated holding slot 360 residing in the plate member 340, the attachment beams 390, the vertical beam 375, attachment fasteners 395, a plate holding loop 370, and a backrest 310 having a front side 315, suspension hole 325, first elongated hole 330; and second elongated hole 335. The elongated holding slot 360 roughly divides the plate member 340 to a proximal section 363, which is closer to the attachment beams 390, and a distal section, which is farther from the attachment beams 390.

Figure 6C:
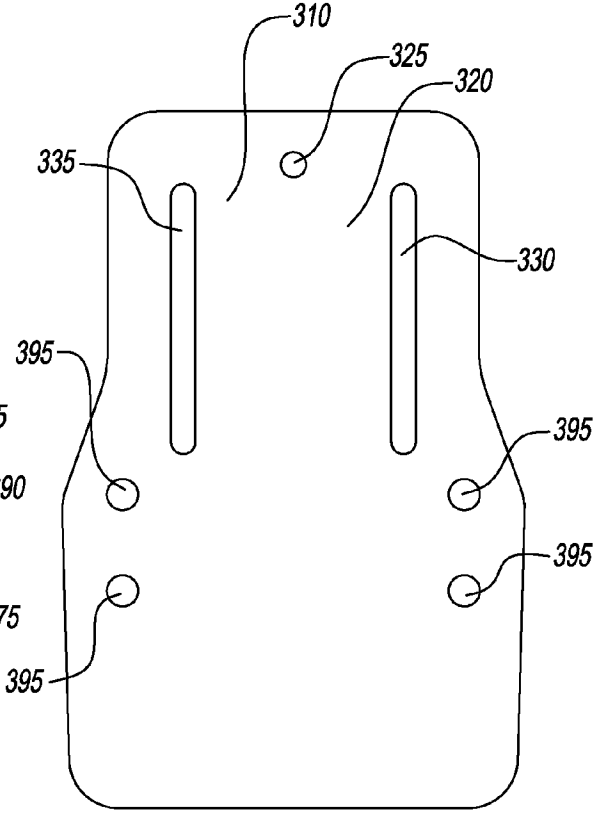
FIG. 6A-G show a fourth preferred embodiment of the pry bar holder while it is attached to a backrest.
Figure 6B:
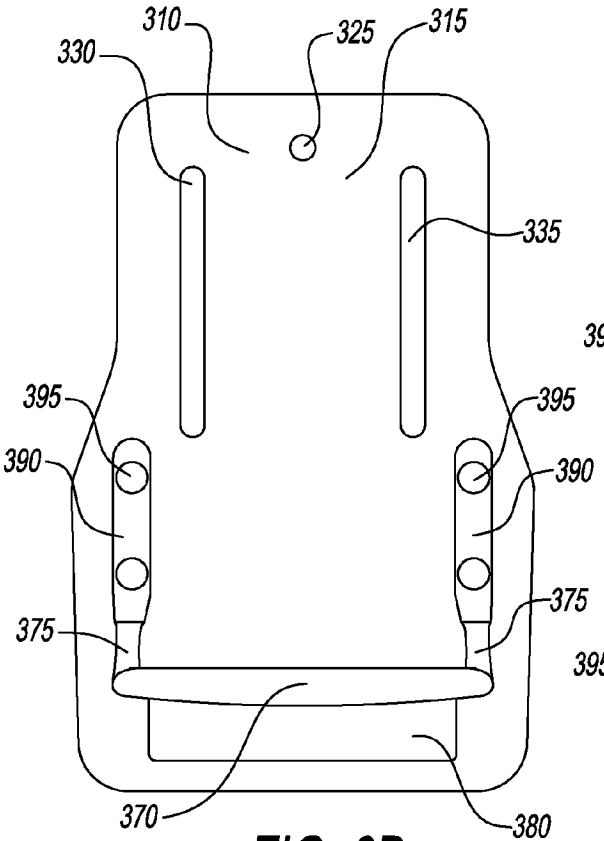
Figure 6A:
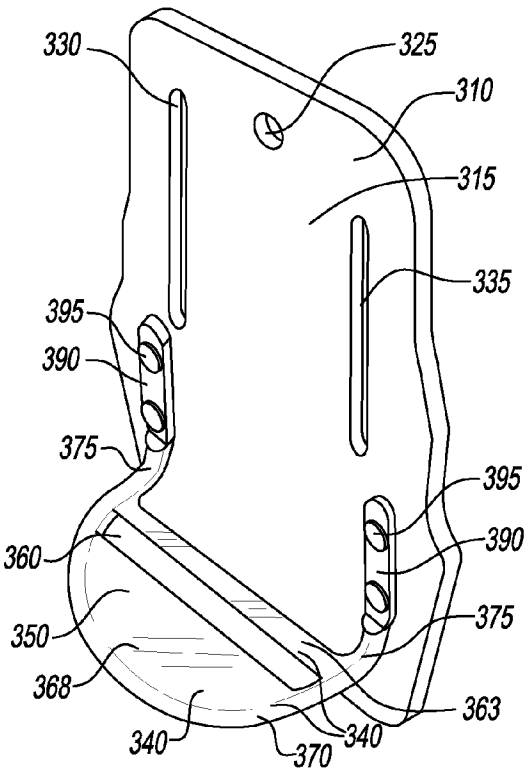

FIG. 6B is a front view of the fourth preferred embodiment of a pry bar holder 300 when the pry bar holder is attached to a backrest 310. Shown are the plate member 340, the attachment beams 390, the vertical beam 375, attachment fasteners 395, the blocking beam 380, and the plate holding loop 370.

Figure 1B:
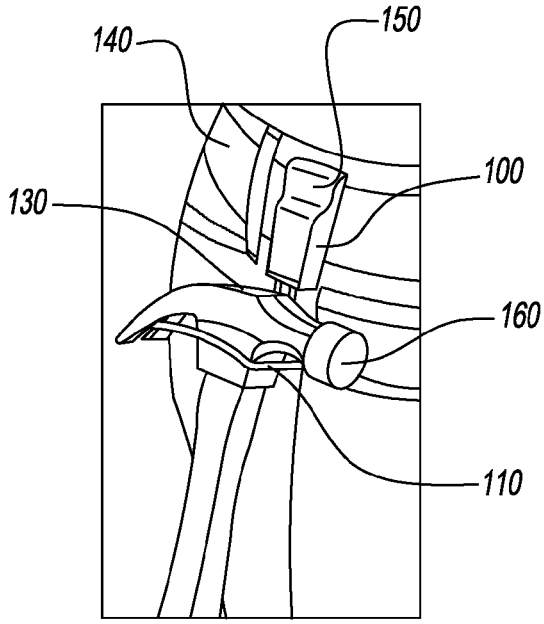
FIG. 1B PRIOR ART
FIG. 1B shows an isometric view of a craftsperson carrying a hammer in a prior art tool holder attached to their belt via a belt attachment.
Figure 2A:
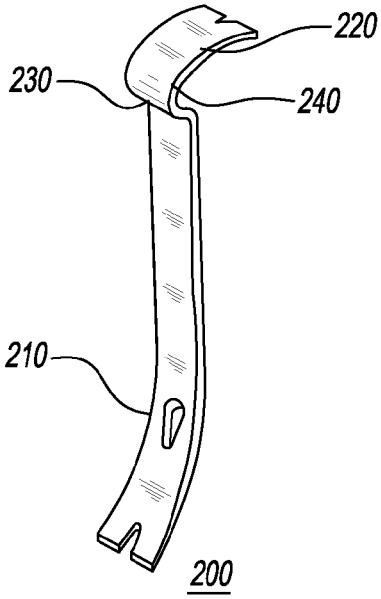
FIG. 2A shows an isometric view of a prior art pry bar.
Figure 2B:
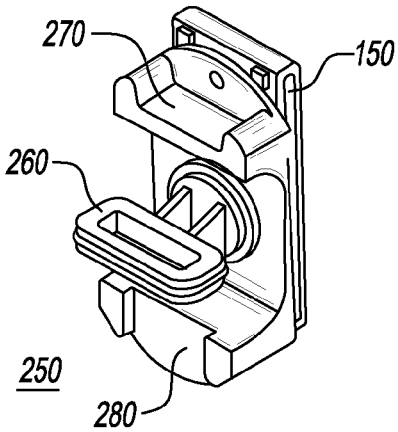
FIG. 2B PRIOR ART
FIG. 2B shows an isometric view of a prior art pry bar holder.

Here the backrest 310 is specially designed to enable easier engagement with a belt. Unlike the backrest 120 shown in FIG. 1, here no additional devices are needed to attach the backrest 310 to a belt. The backrest 310 has a suspension hole 325, a first elongated hole 330, and a second elongated hole 335. The backrest 310 is preferably made of flexible but robust materials, such as but not limited to: leather, synthetic leather, rubber, and semi-rigid plastic. A belt may be threaded through both of the elongated holes, allowing the belt to engage the backrest 310 so that the belt and the backrest 310 are substantially parallel. In alternative, the suspension hole 325 may be used when there are suitable protrusions on the belt.

The pry bar holder 300 may be either removably or permanently connected to the backrest 310. When combined, the backrest 310 may be considered a part of a pry bar holder. In this particular embodiment, the attachment beams 390 are connected to the backrest 310 with attachment fasteners 395, which may be any kind of fasteners such as screws or rivets. When attached, the plate member 340 is substantially perpendicular to the backrest 310. Accordingly, when the backrest 310 is hung from a belt, the plate member 340 is substantially parallel to the ground and a pry bar that is asserted in the elongated holding slot 360 will be vertical to the ground.

For the fourth preferred embodiment of a pry bar holder 300, the attachment structures, which include the attachment beams 390, the plate holding loop 370, and the vertical beams 375, are integrated with the plate member 340. In essence, here the plate member 340 and the attachment structures are molded or co-molded and form a single piece. Such a design improves the robustness of the pry bar holding. Since the different parts are integrated together, it is preferred that the parts are made of the same materials, as stated for the first preferred embodiment. However, if it is technically possible and desired, the various structures may also be made from different materials.

FIG. 6C is a back view of the fourth preferred embodiment of a pry bar holder 300 when the pry bar holder is attached to a backrest 310. Shown are a backrest 310 having a back side 320, suspension hole 325, first elongated hole 330; and second elongated hole 335.

Figure 6D:
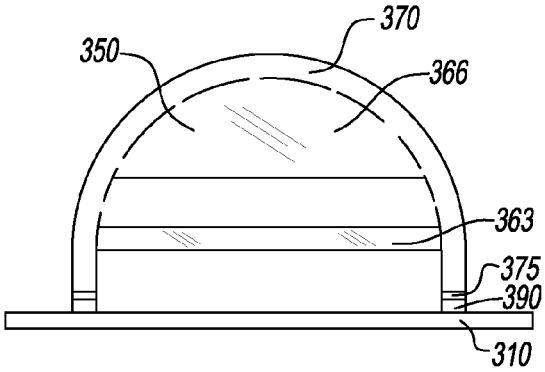

FIG. 6D is a top view of the fourth preferred embodiment of a pry bar holder 300 when the pry bar holder is attached to a backrest 310. Shown are the are plate member 340 having a top surface 350, a proximal section 363, and a distal section 366, and the elongated holding slot 360 residing in the plate member 340, the plate holding loop 370, the attachment beams 390, the vertical beams 375, the attachment fasteners 395, and backrest 310.

Figure 6E:
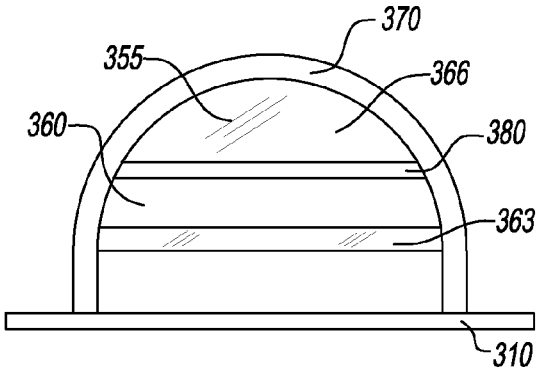

FIG. 6E is a bottom view of the fourth preferred embodiment of a pry bar holder 300 when the pry bar holder is attached to a backrest 310. Shown are the are plate member 340, the elongated holding slot 360 residing in the plate member 340 and roughly divide the plate member 340 into the proximal section 363 and the distal section 366, the blocking beam 380 that is attached to the bottom surface 355 of plate member 340 and resides adjacent to the elongated holding slot 360 on the distal section 366 of plate member 340, the plate holding loop 370, and the backrest 310.

Figure 6F:
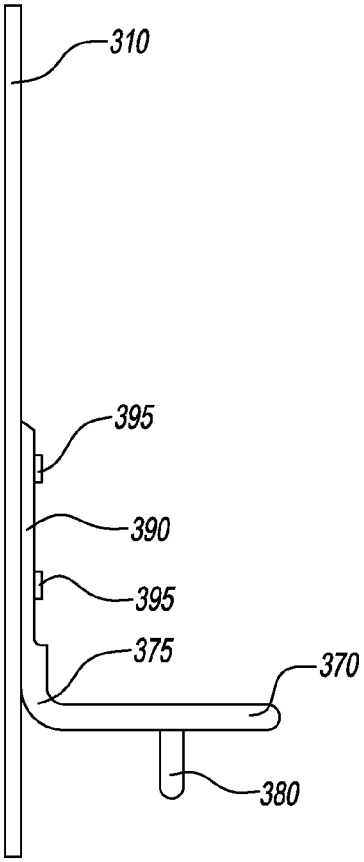

FIG. 6F is a first side view of the fourth preferred embodiment of a pry bar holder 300 when the pry bar holder is attached to a backrest 310. Shown are the plate holding loop 370, the blocking beam 380, the attachment beams 390, the vertical beams 375, the attachment fasteners 395, and the backrest 310.

Figure 6G:
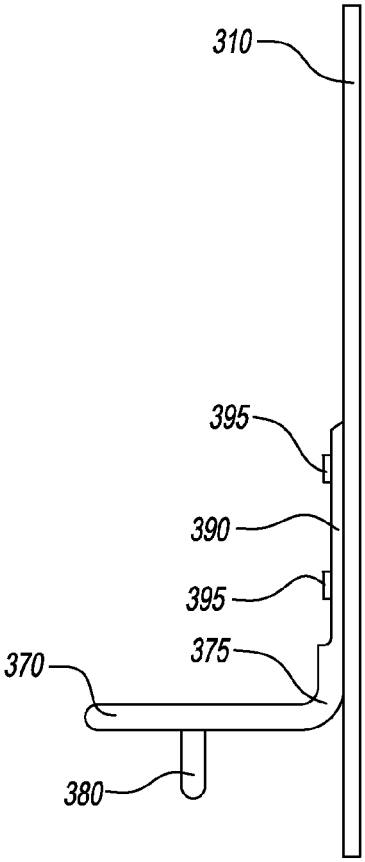

FIG. 6G is a second side view of the fourth preferred embodiment of a pry bar holder 300 when the pry bar holder is attached to a backrest 310. Shown are the plate holding loop 370, the blocking beam 380, the attachment beams 390, the vertical beams 375, the attachment fasteners 395, and the backrest 310.

Figure 7A:
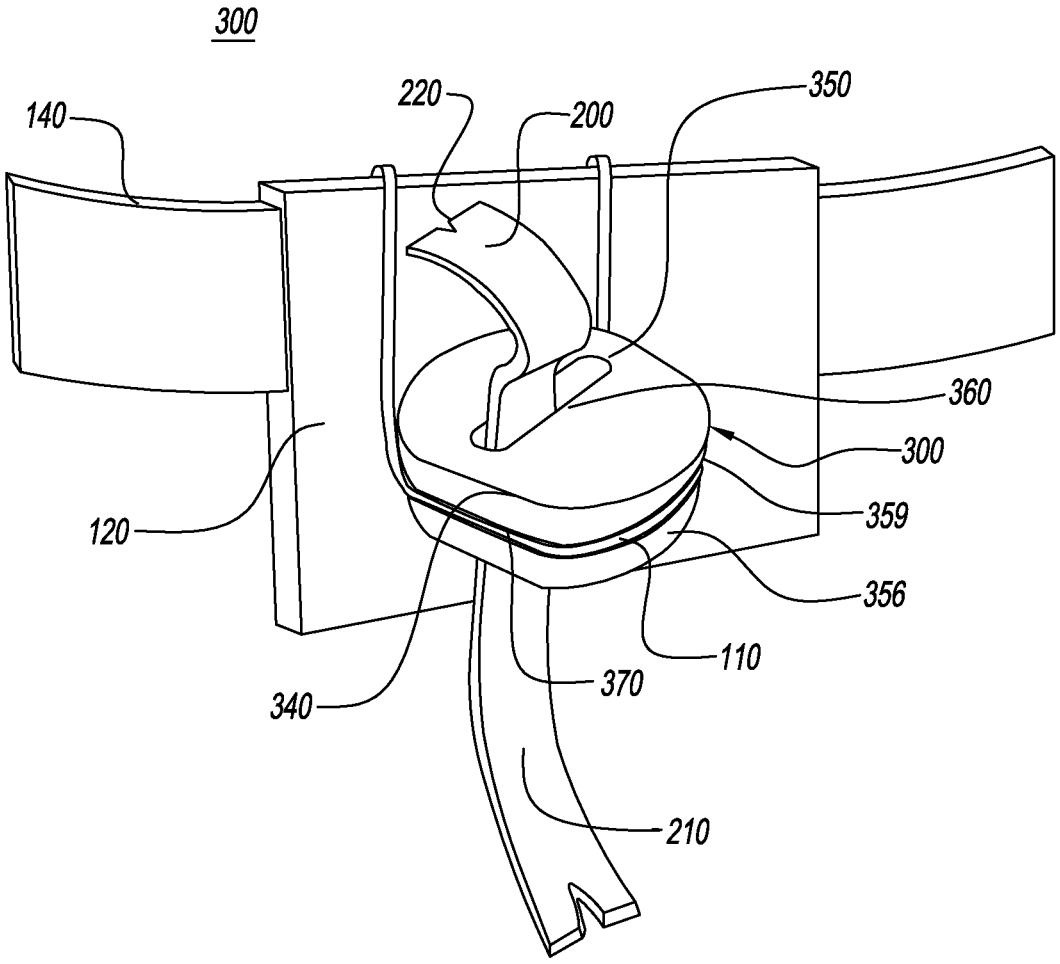
FIG. 7A-E show a fifth preferred embodiment of the pry bar holder.

FIG. 7A-E show a fifth preferred embodiment of the pry bar holder. FIG. 7A is a top perspective view of the fifth embodiment when it is in use. The plate member 340 is shown inserted in a plate holding loop 370, which is connected to a generic backrest. The generic backrest is shown attached to a belt 140 by means of a belt attachment 150. The essential element of the fifth preferred embodiment is the plate member 340.

As shown in FIG. 7A, the pry bar holder may have a plate member 340 that may have a top surface 350 and a side surface 356. A groove 359 may formed in the side surface 356 of the plate member 340. The groove 359 may run substantially parallel to the top surface 350 of the plate member 340. The groove 359 may also be sized to be a secure fit to the inside of a plate holding loop 370 of the generic tool holder 100 that the plate member 340 may be designed for.

The plate member 340 may also have a elongated holding slot 360 that connects the top surface 350 of the plate member 340 to the bottom surface 355 (not shown in this figure). The elongated holding slot 360 is preferably sized to be a loose fit to the pry bar 200 for which the plate member 340 is designed.

The generic tool holder 100 may also have a tool backrest 120. The elongated holding slot 360 may be sized so that when the elongated handle 210 of the pry bar 200 is seated in the elongated holding slot 360, and the lateral offset 240 of the pry bar 200 rests on the top surface 350 of the plate member 340, the claw 220 extending perpendicular to the handle of the pry bar 200 may rest against the tool backrest 120.

Figure 7B:
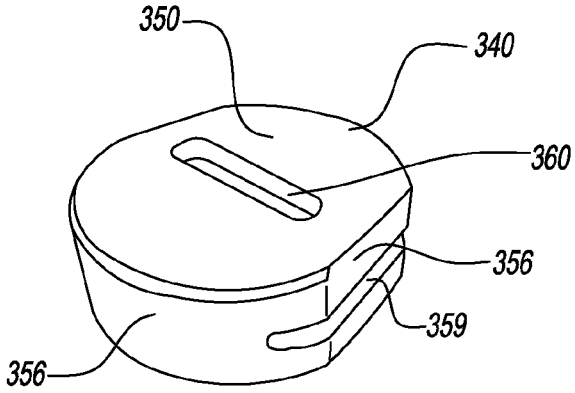

FIG. 7B is a back perspective view of a plate member of the fifth preferred embodiment of this invention. In this view of the plate member 340, the elongated holding slot 360 and the groove 359 may be seen clearly. As shown in this figure, the groove 359 may only extend around part of the side surface 356 of the plate member 340. The groove 359 may, however, run substantially parallel to the top surface 350.

Figure 7C:
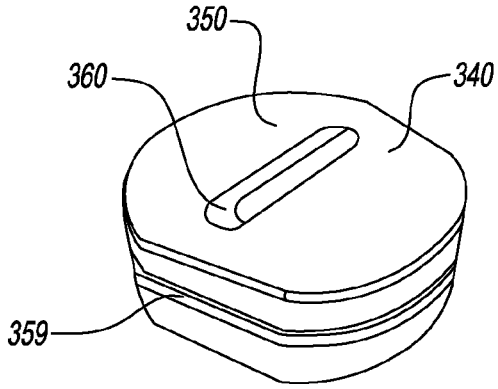

FIG. 7C is a front perspective view of a plate member of the fifth preferred embodiment of this invention. In this view, the groove 359 and the elongated holding slot 360 may be seen clearly. As shown, the groove 359 may run substantially parallel to the top surface 350 and may be positioned substantially midway between the top surface 350 and the bottom surface 355.

Figure 7D:
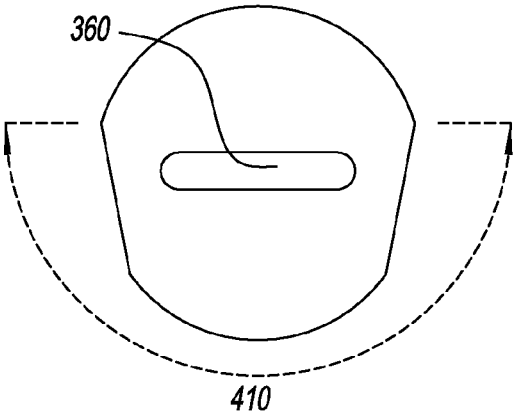

FIG. 7D is a top view of a plate member of the fifth preferred embodiment of this invention.

The extent of the groove 410 may represent the extent of the groove 359 formed in the side surface 356 of the plate member 340. The groove 359 may, for instance, extend along approximately two-thirds of the side surface 356. The groove 359 may also extend for up to the entire circumference of the plate member 340, or the groove 359 may extend for an angular distance that may range from an angle 410 of 90 degrees to one of 270 degrees.

The top view of FIG. 7D shows that the elongated holding slot 360 may be formed to have a substantially constant rounded rectangular cross-section. The elongated holding slot 360 may also be formed to have another cross section such as, but not limited to, a substantially constant rectangular, oval or elliptical cross-section.

Figure 7E:
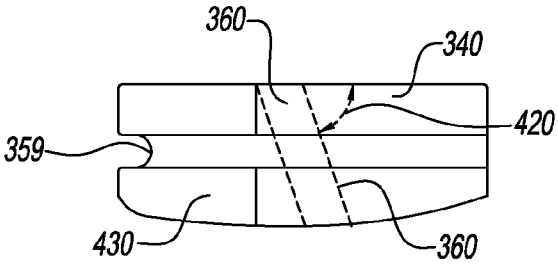

FIG. 7E shows a side view of an embodiment of a plate member 340 of this invention. The plate member 340 may have a thickness that is sufficient to provide stable support for the pry bar 200, holding it in a substantially vertical position. The plate member 340 may for instance have a thickness within a range of 0.5 inches to 1.5 inches, or depending of the material and density of the plate member 340 the thickness may be as great as 6 inches.

The elongated holding slot 360 may be obliquely angled. In a preferred embodiment, the obliquely angled slot may be at an angle in the range of 80 degrees or more with respect to the top surface 350.

In a preferred embodiment the plate member 340 may be solid and made of a suitably moldable or machinable material such as, but not limited to, to vulcanized rubber. The plate member 340 may also be made of other materials such as, but not limited to, suitably light metals such as aluminum or titanium, suitably hard wearing wood, plastic or some combination thereof. The material may also be a foamed or other wise perforated or shaped to reduce weight and material costs, and may be coated with suitably hardwearing, but protective coatings such as, but not limited to, rubber, plastic, wood, cork or some combination thereof.

In order to use the plate member 340 to make a full pry bar holder, a craftsperson 130 may first have to obtain a plate holding loop 370 for which the plate member 340 is designed, typically a common or inexpensive plate holding loop 370 that may be designed to hold a hammer. The craftsperson 130 may then attach the plate holding loop 370 to their belt 140. Once attached, the craftsperson 130 may then fit the plate member 340 to the plate holding loop 370. This may be done by, for instance, aligning the groove 359 in the plate member 340 to the inside of the plate holding loop 370 plate holding loop 370. The plate member 340 may then be securely wedged in with a back surface of the plate member 340 pressing against the tool backrest 120 of the plate holding loop 370. When the craftsperson 130 is not using their pry bar 200 they may now temporarily store it by inserting the second claw 290 of the pry bar 200 into the elongated holding slot 360 of the plate member 340, and allowing the elongated handle 210 of the pry bar 200 to slide down into the slot. When the lateral offset 240 of the pry bar 200 comes to rest on the top surface 350 of the plate member 340, the pry bar will be held with its claw 220 that extends perpendicular to the handle resting against the tool backrest 120 of the plate holding loop 370.

One of ordinary skill in the art will readily appreciate that although the pry bar holder has been described with respect to a pry bar 200, a similar approach may be used to adapt a plate member 340 to hold a wide variety of tools such as, but not limited to, a molding bar, a wrecking bar, a claw bar or a double ended claw bar, or some combination thereof.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed is:

1. A tool holder for carrying a tool on a belt comprising:

a plate member having a top surface and a bottom surface, wherein the plate member has an elongated holding slot connecting the top surface to the bottom surface and sized to be a loose fit to a pry bar, the elongated holding slot roughly divides the plate member to a proximal section and a distal section;

a blocking beam attached to the bottom surface of the plate member, residing adjacent to the elongated holding slot and on the distal section of the plate member; and at least one intermediary beam connecting the plate member to attachment structures that affix the plate member to the belt.

2. The holder as claim 1, wherein the attachment structures comprise:

a least one attachment beam; and a plate holding loop connected to the attachment beam, wherein the plate holding loop holds the plate member substantially perpendicular to the attachment beam.

3. The holder as claim 2, further comprising:

a backrest having a front side and a back side, wherein the attachment structures attach the plate member to the backrest, and the backrest has belt engaging mechanisms that engage the belt, wherein the belt engaging mechanism comprises a first elongated hole and a second elongated hole, the first elongated hole and the second elongated hole connecting the front side and the back side of the backrest and being generally parallel, allowing a belt to engage the first elongated hole and the second elongated hole, so that the holder may hang from the belt.

4. The holder as claim 2, wherein the attachment structures are made of metal and the plate member is made of rigid plastic.

5. The holder as claim 1, wherein the plate member comprises:

a top half; and a bottom half; wherein the top half and the bottom half have fitting grooves to hold the plate holding loop, the top half and the bottom half have plate holding loop wraps which form a grip around the plate holding loop and hold the plate member to the plate holding loop, and the top half and the bottom half are connected by fasteners to form the plate member.

6. The holder as claim 5, further comprising:

a backrest having a front side and a back side, wherein the attachment structures attach the plate member to the backrest, and the backrest has belt engaging mechanisms that engage the belt, wherein the belt engaging mechanism comprises a first elongated hole and a second elongated hole, the first elongated hole and the second elongated hole connecting the front side and the back side of the backrest and being generally parallel, allowing a belt to engage the first elongated hole and the second elongated hole, so that the holder may hang from the belt.

7. The holder as claim 5, further comprising:

a backrest having a front side and a back side, wherein the attachment structures are made of metal, the plate member is made of rigid plastic, and the attachment structures attach the plate member to the backrest, and the backrest has belt engaging mechanisms that engage the belt, wherein the belt engaging mechanism comprises a first elongated hole and a second elongated hole, the first elongated hole and the second elongated hole connecting the front side and the back side of the backrest and being generally parallel, allowing a belt to engage the first elongated hole and the second elongated hole, so that the holder may hang from the belt.

8. The holder as claim 5, further comprising:

a backrest having a front side and a back side, wherein the attachment structures are made of metal, the plate member is made of rigid plastic, and the attachment structures attach the plate member to the backrest, and the backrest has belt engaging mechanisms that engage the belt, wherein the belt engaging mechanism comprises a first elongated hole and a second elongated hole, the first elongated hole and the second elongated hole connecting the front side and the back side of the backrest and being generally parallel, allowing a belt to engage the first elongated hole and the second elongated hole, so that the holder may hang from the belt.

9. The holder as claim 1, wherein the plate member comprises:

a top half; and a bottom half; wherein the top half and the bottom half have fitting groves to hold the plate holding loop, the top half and the bottom half are connected by a plate holding loop wrap wherein the plate holding loop wrap form a grip around the plate holding loop and hold the plate member to the plate holding loop, and the top half and the bottom half are connected by fasteners to form the plate member.

10. The holder as claim 9, wherein the top half comprises:

a top half base, and a overlaying layer firmly attached to the top half base; wherein the plate holding loop wrap is an extension of the overlying layer.

11. The holder as claim 10, further comprising:

a backrest having a front side and a back side, wherein the attachment structures attach the plate member to the backrest, and the backrest has belt engaging mechanisms that engage the belt, wherein the belt engaging mechanism comprises a first elongated hole and a second elongated hole, the first elongated hole and the second elongated hole connecting the front side and the back side of the backrest and being generally parallel, allowing a belt to engage the first elongated hole and the second elongated hole, so that the holder may hang from the belt.

12. The holder as claim 1, wherein the attachment structures comprise:

a least one attachment beam; and a plate holding loop connected to the attachment beam, wherein the plate holding loop holds the plate member substantially perpendicular to the attachment beam, and the plate member, the plate holding loop, and the attachment beam form one integral piece.

13. The holder as claim 12, the attachment structures further comprise:

a horizontal beam integrally attached to the attachment beam and the plate member, proving support to the plate member.

14. The holder as claim 13, further comprising:

a backrest having a front side and a back side, wherein the attachment structures and the plate member are made of rigid plastic, and the attachment structures attach the plate member to the backrest, and the backrest has belt engaging mechanisms that engage the belt, wherein the belt engaging mechanism comprises a first elongated hole and a second elongated hole, the first elongated hole and the second elongated hole connecting the front side and the back side of the backrest and being generally parallel, allowing a belt to engage the first elongated hole and the second elongated hole, so that the holder may hang from the belt.

15. The holder as claim 12, further comprising:

a backrest having a front side and a back side, wherein the attachment structures attach the plate member to the backrest, and the backrest has belt engaging mechanisms that engage the belt, wherein the belt engaging mechanism comprises a first elongated hole and a second elongated hole, the first elongated hole and the second elongated hole connecting the front side and the back side of the backrest and being generally parallel, allowing a belt to engage the first elongated hole and the second elongated hole, so that the holder may hang from the belt.

16. The holder as claim 1, further comprising:

a backrest having a front side and a back side, wherein the attachment structures attach the plate member to the backrest, and the backrest has belt engaging mechanisms that engage the belt.

17. The holder as claim 16, wherein the belt engaging mechanism comprises a first elongated hole and a second elongated hole, the first elongated hole and the second elongated hole connecting the front side and the back side of the backrest and being generally parallel, allowing a belt to engage the first elongated hole and the second elongated hole, so that the holder may hang from the belt.

18. A pry bar holder to for carrying a pry bar on a belt comprising:

a plate member having a top surface, a bottom surface and a side surface;

a holding loop;

a backrest;

a groove in the side surface, the groove formed to be substantially parallel to the top surface and sized to securely fit an inside of a holding loop, which attaches the plate member to the backrest; and an elongated holding slot connecting the top surface to the bottom surface and sized to be a loose fit to the pry bar, wherein the holder has a thickness and the thickness is sufficient to provide stable support for the pry bar, holding the pry bar in a substantially vertical orientation.

19. The holder of claim 18 wherein the elongated holding slot is substantially obliquely angled with respect the top surface.

* * * * *